US009349521B2

(12) United States Patent
Tsai et al.

(10) Patent No.: US 9,349,521 B2
(45) Date of Patent: May 24, 2016

(54) PRIMARY SIDE MODULE AND TRANSFORMER WITH SAME

(71) Applicant: DELTA ELECTRONICS, INC., Taoyuan Hsien (TW)

(72) Inventors: Hsin-Wei Tsai, Taoyuan Hsien (TW); Yu-Chieh Li, Taoyuan Hsien (TW); Chia-Cheng Yang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 28 days.

(21) Appl. No.: 14/074,441

(22) Filed: Nov. 7, 2013

(65) Prior Publication Data

US 2014/0327511 A1 Nov. 6, 2014

(30) Foreign Application Priority Data

May 3, 2013 (TW) ..... 102115817 A

(51) Int. Cl.

| | |
|---|---|
| ***H01F 27/28*** | (2006.01) |
| ***H01F 27/30*** | (2006.01) |
| ***H01F 27/24*** | (2006.01) |
| *H01F 27/26* | (2006.01) |

(52) U.S. Cl.

CPC ..... *H01F 27/28* (2013.01); *H01F 27/2847* (2013.01); *H01F 27/30* (2013.01); *H01F 27/266* (2013.01)

(58) Field of Classification Search

CPC ..... H01F 30/06; H01F 17/045; H01F 29/146; H01F 19/04; H01F 27/34; H01F 27/28; H01F 27/2847; H01F 27/266; H01F 27/30

USPC ..... 336/220, 177, 198, 212, 213, 221

See application file for complete search history.

(56) References Cited

U.S. PATENT DOCUMENTS

| | | | | |
|---|---|---|---|---|
| 3,510,858 | A * | 5/1970 | Flanagan | 340/870.43 |
| 4,462,016 | A * | 7/1984 | Bland et al. | 336/192 |
| 5,010,314 | A | 4/1991 | Estrov | |

(Continued)

FOREIGN PATENT DOCUMENTS

| | | |
|---|---|---|
| CN | 1059231 | 3/1992 |
| JP | 2000-223320 | 8/2000 |

(Continued)

*Primary Examiner* — Elvin G Enad
*Assistant Examiner* — Kazi Hossain
(74) *Attorney, Agent, or Firm* — Kirton McConkie; Evan R. Witt

(57) ABSTRACT

A transformer includes a primary side module, a secondary winding structure, and a magnetic core assembly. The primary side module includes a primary winding structure, a first covering structure and a second covering structure. The primary winding structure has a first opening. The first covering structure includes a second opening corresponding to the first opening and a first receiving recess for accommodating the primary winding structure. The first receiving recess is covered and sealed by the second covering structure. The second covering structure includes a third opening corresponding to the first opening. The first opening, the second opening and the third opening are in communication with each other to be defined as a channel. The secondary winding structure includes a fourth opening, which is in communication with the channel. The magnetic core assembly is partially embedded within the channel and the fourth opening.

11 Claims, 6 Drawing Sheets

(56) References Cited

U.S. PATENT DOCUMENTS

| | | | | |
|---|---|---|---|---|
| 5,684,445 | A * | 11/1997 | Kobayashi et al. | 336/83 |
| 5,844,459 | A * | 12/1998 | Larsen | 336/92 |
| 5,886,610 | A * | 3/1999 | Canova | 336/83 |
| 6,522,233 | B1 * | 2/2003 | Kyoso et al. | 336/200 |
| 8,203,415 | B2 * | 6/2012 | Wu et al. | 336/198 |
| 8,922,322 | B2 * | 12/2014 | Lin et al. | 336/208 |
| 2002/0067237 | A1 * | 6/2002 | Nakata | H01F 27/29 336/212 |
| 2007/0057757 | A1 * | 3/2007 | Chen et al. | 336/212 |
| 2009/0278646 | A1 * | 11/2009 | Chen | H01F 27/325 336/177 |
| 2010/0265026 | A1 * | 10/2010 | Soendker et al. | 336/200 |
| 2011/0090037 | A1 * | 4/2011 | Tsai | H01F 27/324 336/220 |
| 2011/0115598 | A1 * | 5/2011 | Wu | H01F 27/325 336/212 |
| 2012/0257419 | A1 * | 10/2012 | Kaneko | H01F 27/306 363/15 |
| 2013/0154782 | A1 * | 6/2013 | Won | H01F 5/02 336/192 |
| 2013/0194061 | A1 * | 8/2013 | Wei | H01F 27/292 336/192 |

FOREIGN PATENT DOCUMENTS

| | | | |
|---|---|---|---|
| JP | 2000223320 | * | 8/2000 |
| JP | 2001-297924 | | 10/2001 |
| JP | 2001297924 | | 10/2001 |
| TW | M372524 | | 1/2010 |

* cited by examiner

PRIMARY SIDE MODULE AND TRANSFORMER WITH SAME

TECHNICAL FIELD

The present disclosure relates to a primary side module, and more particularly to a primary side module capable of increasing the universal usability and the assembling speed and reducing the time cost and the labor cost. The present disclosure also relates to a transformer with the primary side module.

DESCRIPTION OF THE RELATED ART

A transformer is a magnetic element that transfers electric energy from one circuit to another through coils in order to regulate the voltage to a desired range required for powering an electronic device.

FIG. 1 is a schematic perspective view illustrating a conventional transformer. As shown in FIG. 1, the conventional transformer 1 comprises a primary winding structure 10, a secondary winding structure 11, a magnetic core assembly 12, and a plurality of pins 13. Each of the primary winding structure 10 and the secondary winding structure 11 is a flat copper foil sheet. Moreover, the secondary winding structure 11 is wound around a magnetic post of the magnetic core assembly 12 for at least one turn. The primary winding structure 10 is wound around the secondary winding structure 11 for at least one turn. For complying with safety regulations, an insulating tape (not shown) is sheathed around the primary winding structure 10 of the conventional transformer 1. The length of the insulating tape is substantially equal to the length of the primary winding structure 10. The insulating tape is used for isolating the primary winding structure 10 from the secondary winding structure 11. The first ends of the pins 13 are welded on the corresponding primary winding structure 10 or the corresponding secondary winding structure 11. The second ends of the pins 13 are inserted into a substrate 14. Consequently, the assembled transformer 1 can be mounted on the substrate 14.

Although the conventional transformer 1 is able to regulate the voltage, there are still some drawbacks. For example, for complying with the safety regulations, the insulating tape should be attached on the primary winding structure 10. Consequently, the fabricating process of the conventional transformer 1 is time-consuming and labor-intensive. Moreover, since the pins 13 of the conventional transformer 1 are welded on the primary winding structure 10 or the secondary winding structure 11, the time cost and the labor cost of fabricating the conventional transformer 1 are further increased. Moreover, if the insulating tape is not precisely attached on the primary winding structure 10, the insulating tape is readily shifted relative to the primary winding structure 10. Under this circumstance, the conventional transformer 1 fails to comply with the safety regulation, and use of the conventional transformer 1 is at risk. Moreover, since the universal usability of the conventional transformer 1 is unsatisfactory, it is difficult to expand the conventional transformer 1. If the power requirement is increased, it is necessary to design and produce new molds, and thus the fabricating cost is further increased.

Therefore, there is a need of providing a primary side module and a transformer with such primary side module in order to obviate the above drawbacks.

BRIEF SUMMARY

The present disclosure provides a primary side module and a transformer with such primary side module in order to obviate the above drawbacks encountered by the prior arts and increase the universal usability and the assembling speed and reduce the time cost and the labor cost.

In accordance with an aspect of the present disclosure, there is provided a transformer. The transformer includes at least one primary side module, at least one secondary winding structure, and a magnetic core assembly. The primary side module includes a primary winding structure, a first covering structure and a second covering structure. The primary winding structure has a first opening. The first covering structure includes a second opening corresponding to the first opening and a first receiving recess for accommodating the primary winding structure. The first receiving recess is covered and sealed by the second covering structure. The second covering structure includes a third opening corresponding to the first opening. The first opening, the second opening and the third opening are in communication with each other to be defined as a channel. The secondary winding structure includes a fourth opening, which is in communication with the channel. The magnetic core assembly is partially embedded within the channel and the fourth opening.

In accordance with another aspect of the present disclosure, there is provided a primary side module of a transformer. The primary side module includes a primary winding structure, a first covering structure, and a second covering structure. The primary winding structure has a first opening. The first covering structure includes a second opening corresponding to the first opening and a first receiving recess for accommodating the primary winding structure. The second covering structure is used for covering and sealing the first receiving recess. The second covering structure includes a third opening corresponding to the first opening. The first opening, the second opening and the third opening are in communication with each other to be defined as a channel.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
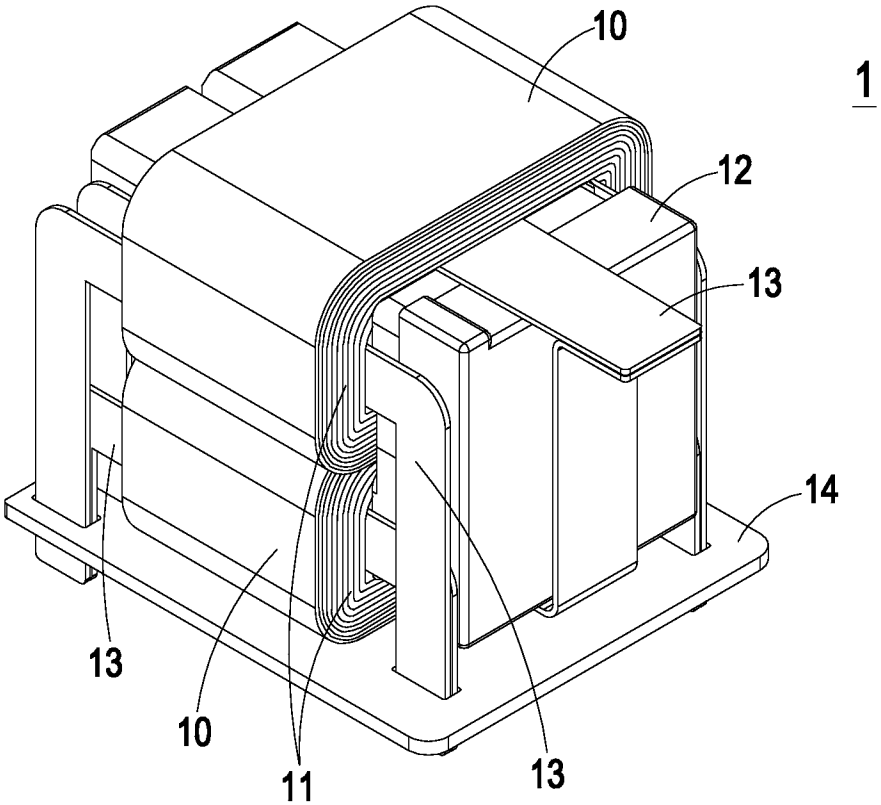
FIG.1 (PRIOR ART)
FIG. 1 is a schematic perspective view illustrating a conventional transformer.
Figure 2:
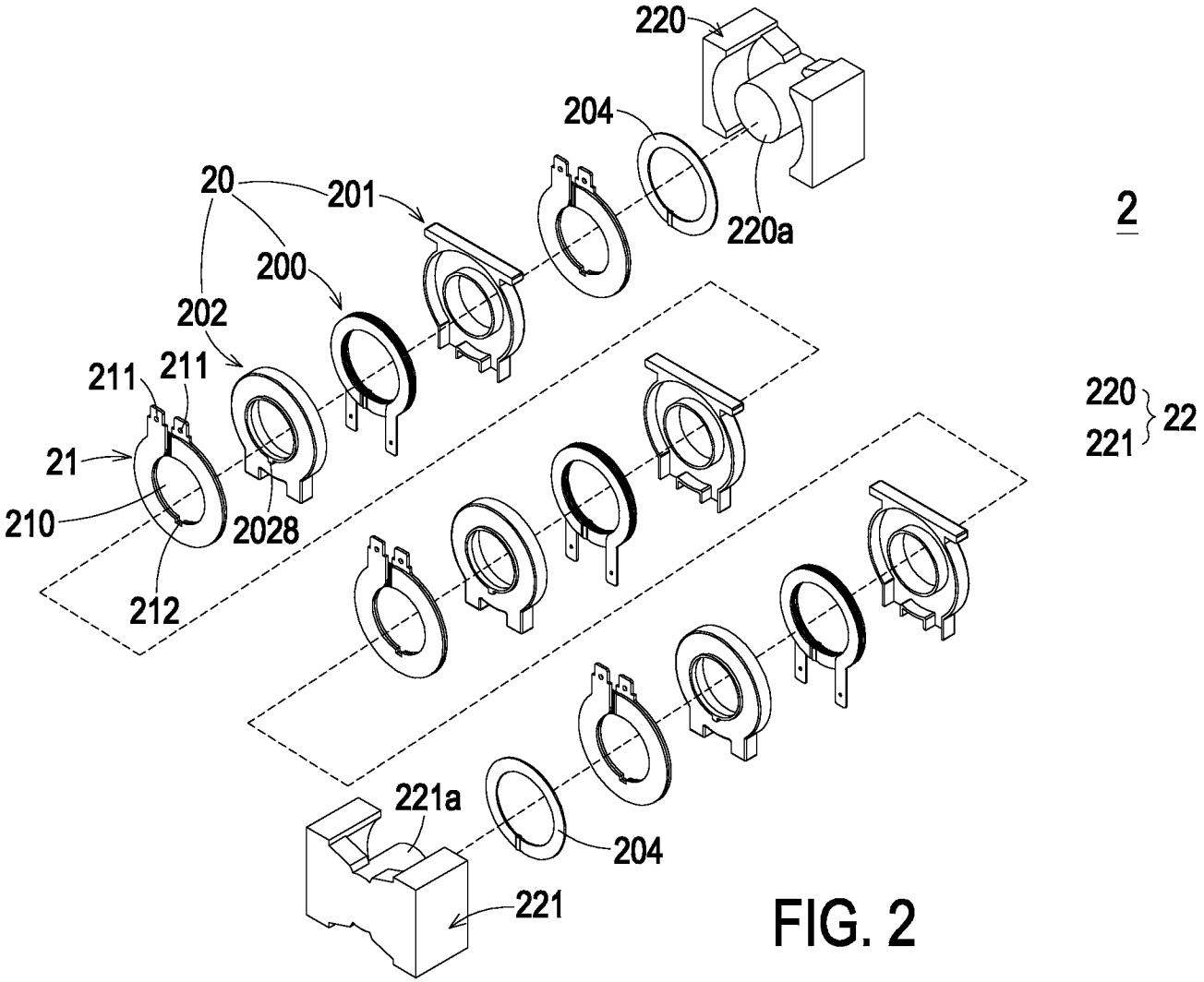
FIG. 2 is a schematic exploded view illustrating a transformer according to an embodiment of the present disclosure.
Figure 3:
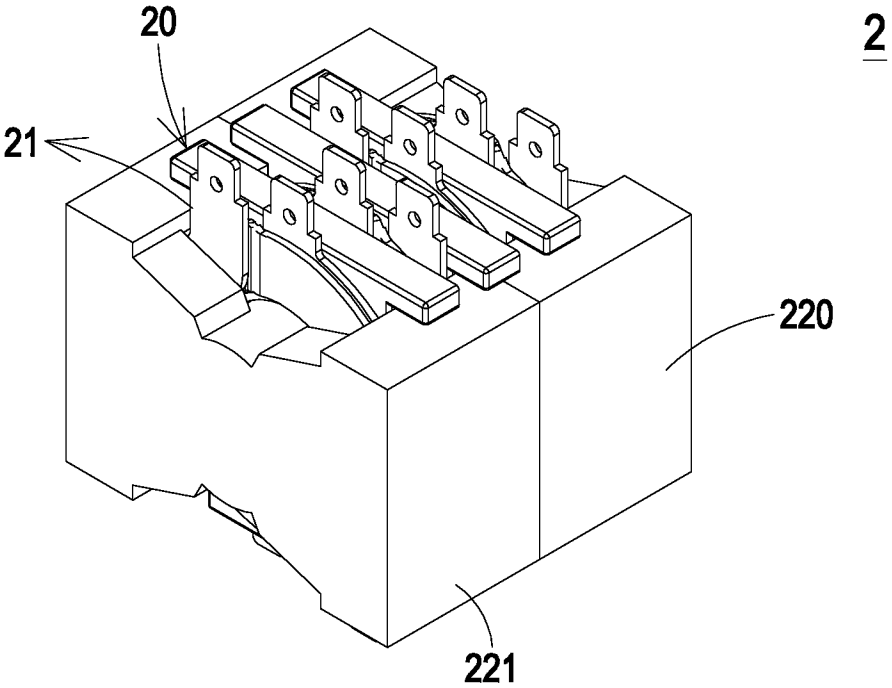
FIG. 3 is a schematic assembled view illustrating the transformer of FIG. 2.

FIG. 2 is a schematic exploded view illustrating a transformer according to an embodiment of the present disclosure. FIG. 3 is a schematic assembled view illustrating the transformer of FIG. 2. As shown in FIGS. 2 and 3, the transformer 2 comprises at least one primary side module 20, at least one secondary winding structure 21, and a magnetic core assembly 22. The magnetic core assembly 22 comprises a first magnetic core 220 and a second magnetic core 221. In this embodiment, the first magnetic core 220 and the second magnetic core 221 are collectively defined as an EE-shaped magnetic core assembly. Moreover, the first magnetic core 220 comprises a middle post 220*a*, and the second magnetic core 221 comprises a middle post 221*a*.

In this embodiment, as shown in FIG. 2, the transformer 2 comprises three primary side modules 20, four secondary winding structures 21, and the magnetic core assembly 22. Each of the secondary winding structures 21 is substantially a ring-shaped conductive structure with a fourth opening 210. Moreover, the ring-shaped conductive structure of the secondary winding structure 21 can be a single-piece and single-turn structure, a multi-piece and single-turn structure or a single-piece and multi-turn structure, but is not limited thereto. The both terminals of the secondary winding structure 21 are formed as two second pins 211.

Figure 4:
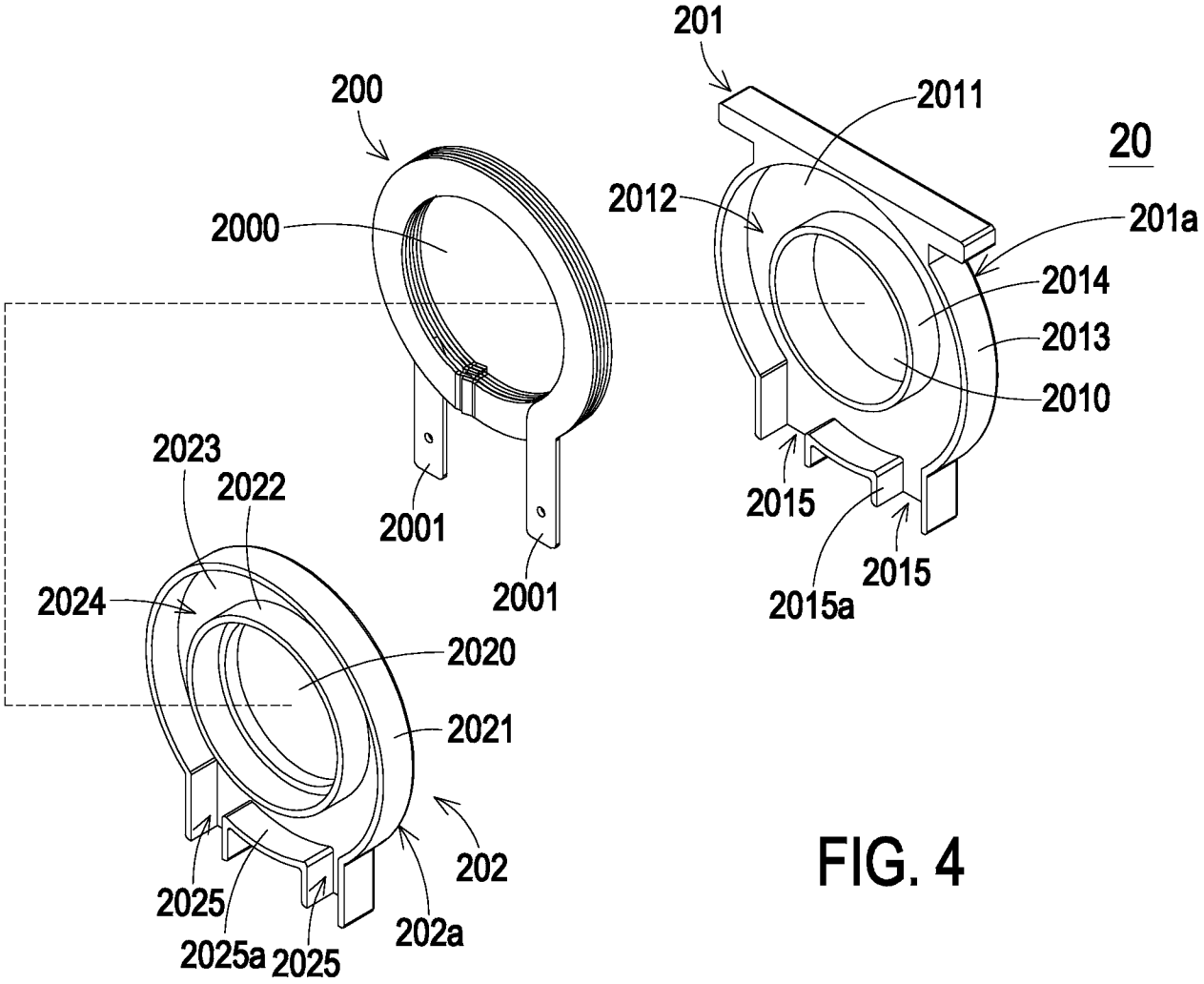
FIG. 4 is a schematic enlarged view illustrating the primary side module of FIG. 2.

FIG. 4 is a schematic enlarged view illustrating the primary side module of FIG. 2. Please refer to FIGS. 2, 3 and 4. The primary side module 20 comprises a primary winding structure 200, a first covering structure 201, and a second covering structure 202. The primary winding structure 200 is substantially a ring-shaped conductive structure with a first opening 2000. Moreover, the ring-shaped conductive structure of the primary winding structure 200 can be a single-piece and single-turn structure, a multi-piece and single-turn structure or a single-piece and multi-turn structure, but is not limited thereto. The both terminals of the primary winding structure 200 are formed as two first pins 2001.

The first covering structure 201 comprises a second opening 2010 corresponding to the first opening 2000 of the primary winding structure 200. The first covering structure 201 comprises a first receiving recess 2012, which is arranged around the second opening 2010. The shape of the first receiving recess 2012 matches the shape of the primary winding structure 200. For example, the first receiving recess 2012 is ring-shaped. The first receiving recess 2012 is used for accommodating the primary winding structure 200.

In this embodiment, the first covering structure 201 comprises a first main body 201*a*, a first outer wall 2013, and a first inner wall 2014. The first outer wall 2013 is vertically protruded from an outer periphery of a first inner surface 2011 of the first main body 201*a*. The first inner wall 2014 is vertically protruded from an inner periphery of the first inner surface 2011 of the first main body 201*a*, and located beside the second opening 2010. In other words, the first inner wall 2014 is arranged between the first outer wall 2013 and the second opening 2010. Moreover, the first receiving recess 2012 is defined by the first outer wall 2013, the first inner wall 2014 and the first inner surface 2011 collaboratively.

In this embodiment, the first receiving recess 2012 of the first covering structure 201 comprises two first grooves 2015 corresponding to the two first pins 2001 of the primary winding structure 200. The two first grooves 2015 are defined by the first outer wall 2013, the first inner surface 2011 and a third inner wall 2015*a* collaboratively. The third inner wall 2015*a* is located at an end of the first inner surface 2011. Moreover, the two first grooves 2015 are in communication with the first receiving recess 2012. After the primary winding structure 200 is accommodated within the first receiving recess 2012, the two first pins 2001 are respectively accommodated within the two first grooves 2015 and partially protruded out of the two first grooves 2015.

The second covering structure 202 comprises a third opening 2020 corresponding to the first opening 2000 of the primary winding structure 200. After the primary winding structure 200 is accommodated within the first receiving recess 2012, the first receiving recess 2012 is covered and sealed by the second covering structure 202. Moreover, the first opening 2000, the second opening 2010 and the third opening 2020 are in communication with each other and collaboratively defined as a channel 203 (see FIG. 5 or FIG. 6).

In this embodiment, the second covering structure 202 comprises a second main body 202*a*, a second outer wall 2021, and a second inner wall 2022. The second outer wall 2021 is vertically protruded from an outer periphery of a second inner surface 2023 of the second main body 202*a*. The second inner wall 2022 is vertically protruded from an inner periphery of the second inner surface 2023 of the second main body 202*a*, and located beside the third opening 2020. In other words, the second inner wall 2022 is arranged between the second outer wall 2021 and the third opening 2020. Moreover, the second outer wall 2021, the second inner wall 2022 and the second inner surface 2023 are collaboratively defined as a second receiving recess 2024. The shape of the second receiving recess 2024 matches the shape of the first receiving recess 2012. After the first receiving recess 2012 is covered and sealed by the second covering structure 202, the second receiving recess 2024 is accommodated within the first receiving recess 2012, and the primary winding structure 200 is accommodated within the first receiving recess 2012 and the second receiving recess 2024 collaboratively.

In this embodiment, the second receiving recess 2024 of the second covering structure 202 comprises two second grooves 2025 corresponding to the two first pins 2001 of the primary winding structure 200. The two second grooves 2025 are defined by the second outer wall 2021, the second inner surface 2023 and a fourth inner wall 2025*a* collaboratively. The fourth inner wall 2025*a* is located at an end of the second inner surface 2023. Moreover, the two second grooves 2025 are in communication with the second receiving recess 2024. Moreover, the shape of the second groove 2025 matches the shape of the first groove 2015. After the primary winding structure 200 is accommodated within the first receiving recess 2012, and after the first receiving recess 2012 is covered and sealed by the second covering structure 202, the two first pins 2001 are respectively accommodated within the two first grooves 2015 and the two second grooves 2025 and partially protruded out of the two first grooves 2015 and the two second grooves 2025.

In some embodiments, the first covering structure 201 and the second covering structure 202 are made of an insulating material. Consequently, the first covering structure 201 and the second covering structure 202 can withstand a high temperature (e.g. up to 155° C.). The thickness of the primary winding structure 200 is substantially equal to the depth of the first receiving recess 2012. Consequently, after the primary winding structure 200 is accommodated within the first receiving recess 2012, and after the first receiving recess 2012 is covered by the second covering structure 202, the primary winding structure 200 can be securely fixed in the first receiving recess 2012 by the first covering structure 201 and the second covering structure 202. Alternatively, in some other embodiments, the thickness of the primary winding structure 200 is smaller than the depth of the first receiving recess 2012.

Under this circumstance, the primary winding structure 200 may be fixed in the first receiving recess 2012 through glue.

Hereinafter, a process of assembling the transformer 2 will be illustrated with reference to FIGS. 2 and 3. Firstly, the primary winding structure 200 is accommodated within the first receiving recess 2012 of the first covering structure 201. Consequently, the two first pins 2001 are respectively accommodated within the two first grooves 2015 of the primary winding structure 200 and partially protruded out of the two first grooves 2015. Then, the first receiving recess 2012 is covered and sealed by the second covering structure 202. Consequently, the primary side module 20 is assembled. Under this circumstance, the primary winding structure 200 is accommodated within the first receiving recess 2012 and the second receiving recess 2024 collaboratively, and the two first pins 2001 of the primary winding structure 200 are partially protruded out of the two second grooves 2025. Moreover, the first opening 2000, the second opening 2010 and the third opening 2020 are in communication with each other to be collaboratively defined as the channel 203 (please refer to FIG. 5). Then, the four secondary winding structures 21 and the three primary side modules 20 are alternately arranged between the first magnetic core 220 and the second magnetic core 221 of the magnetic core assembly 22. In this embodiment, a first one of the four secondary winding structures 21 is arranged between the first magnetic core 220 of the magnetic core assembly 22 and an adjacent primary side module 20; a second one of the four secondary winding structures 21 is arranged between two adjacent primary side modules 20; a third one of the four secondary winding structures 21 is arranged between two adjacent primary side modules 20; and a fourth one of the four secondary winding structures 21 is arranged between the second magnetic core 221 of the magnetic core assembly 22 and the adjacent primary side module 20. In other words, the four secondary winding structures 21 are separated from each other by the three primary side modules 20. Moreover, the fourth openings 210 of the four secondary winding structures 21 are aligned with the channels 203 of the three primary side modules 20. After the middle post 220*a* of the first magnetic core 220 and the middle post 221*a* of the second magnetic core 221 are partially embedded within the fourth openings 210 of the secondary winding structures 21 and the channels 203 of the primary side modules 20, the combination of the secondary winding structures 21 and the primary side modules 20 is clamped between the first magnetic core 220 and the second magnetic core 221 of the magnetic core assembly 22. Under this circumstance, the secondary winding structures 21, the primary side modules 20 and the magnetic core assembly 22 are assembled as the transformer 2. Afterwards, the first pins 2001 of the primary winding structure 200 and the second pins 211 of the secondary winding structures 21 are inserted into corresponding insertion holes of a circuit board (not shown).

From the above discussions, the transformer 2 of the present disclosure is fabricated by simply combining the primary winding structure 200, the first covering structure 201 and the second covering structure 202 together. Consequently, the primary winding structure 200 is sealed and covered between the first covering structure 201 and the second covering structure 202. By means of the first covering structure 201 and the second covering structure 202, the primary winding structure 200 can be isolated to comply with the safety regulations. Since it is not necessary to attach the insulating tape on the flat copper foil sheet of the primary winding structure 200, the fabricating process of the transformer 2 of the present disclosure is time-saving and labor-saving. Moreover, the transformer 2 can comply with the safety regulations. Since the primary winding structure 200 and the secondary winding structure 21 are ring-shaped conductive structures, the first pins 2001 and the second pins 211 can be directly formed on the primary winding structure 200 and the secondary winding structure 21, respectively. Since it is not necessary to weld the pins on the primary winding and the second winding like the prior art, the time cost and the labor cost of the fabricating process of the transformer 2 are further reduced. Moreover, the numbers of the primary side modules 20 and the secondary winding structures 21 may be expanded according to the practical requirement. Consequently, even if the power requirement is increased, it is not necessary to design and produce new molds. Under this circumstance, the universal usability of the primary side modules 20 and the secondary winding structures 21 will be enhanced, and the fabricating cost will be reduced.

In some embodiments, after the secondary winding structures 21, the primary side modules 20 and the magnetic core assembly 22 are assembled as the transformer 2, an insulating tape (not shown) may be wound around the outer side of the transformer 2. In some embodiments, the junctions between the first magnetic core 220 and the second magnetic core 221 may be connected with each other through glue. Consequently, the secondary winding structures 21, the primary side modules 20 and the magnetic core assembly 22 are securely combined together.

In some embodiments, the transformer 2 further comprises a plurality of insulating plates 204. The shape of the insulating plate 204 matches the shape of the secondary winding structure 21. In this embodiment, the transformer 2 comprises two insulating plates 204. One insulating plate 204 is arranged between the first magnetic core 220 and the adjacent secondary winding structure 21. The other insulating plate 204 is arranged between the second magnetic core 221 and the adjacent secondary winding structure 21. Due to the insulating plates 204, the secondary winding structures 21 and the magnetic core assembly 22 are not in direct contact with each other. Moreover, if the primary winding structure 200 or the secondary winding structure 21 is a multi-piece and multi-turn structure or a multi-piece and single-turn structure, one insulating plate (not shown) may be arranged between every two adjacent turns or every two adjacent pieces of the multi-piece and multi-turn structure or the multi-piece and single-turn structure. In some embodiments, the first pins 2001 of the primary winding structure 200 and the second pins 211 of the secondary winding structure 21 may be located at the same side of the transformer 2. Alternatively, in some other embodiments, the first pins 2001 and the second pins 211 may be located at different sides of the transformer 2.

Figure 6:
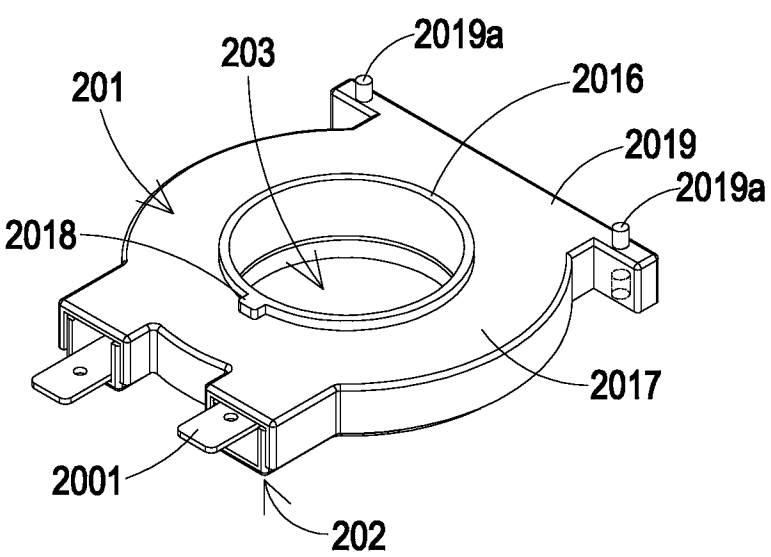
FIG. 6 is a schematic perspective view illustrating the primary side module of FIG. 4 and taken along a second viewpoint.
Figure 5:
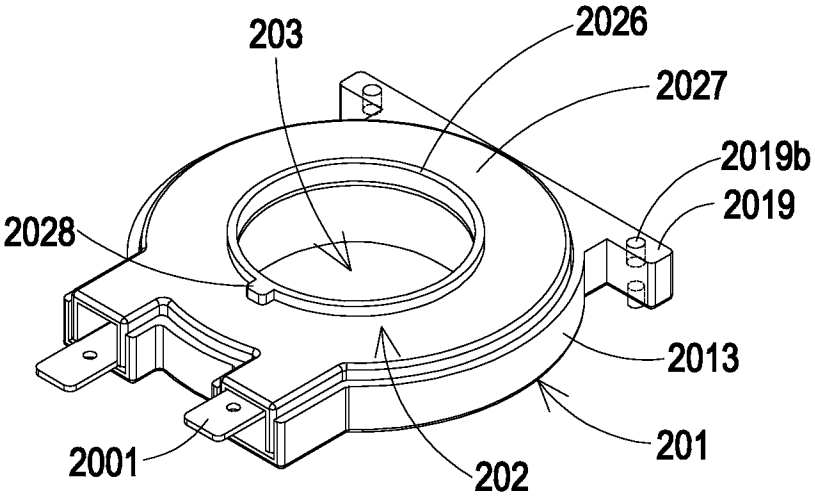
FIG. 5 is a schematic perspective view illustrating the primary side module of FIG. 4 and taken along a first viewpoint.

FIG. 5 is a schematic perspective view illustrating the primary side module of FIG. 4 and taken along a first viewpoint. FIG. 6 is a schematic perspective view illustrating the primary side module of FIG. 4 and taken along a second viewpoint. Please refer to FIGS. 4, 5 and 6. In some embodiments, the first covering structure 201 further comprises a first protrusion part 2016 corresponding to the fourth opening 210 of the secondary winding structures 21. The first protrusion part 2016 is protruded from a first outer surface 2017, which is opposed to the first inner surface 2011. Moreover, the first protrusion part 2016 is located near the second opening 2010. The first protrusion part 2016 is inserted into the fourth opening 210 of the secondary winding structure 21 in order to facilitate assemblage of the transformer 2. In some embodiments, the first covering structure 201 further comprises a first salient 2018. The first salient 2018 is extended from the first protrusion part 2016. Moreover, the secondary winding structure 21 further comprises a notch 212 (please refer to FIG. 2) corresponding to the first salient 2018. The first salient 2018 is inserted into the notch 212 of the secondary winding structure 21.

Similarly, the second covering structure 202 further comprises a second protrusion part 2026 corresponding to the fourth opening 210 of the secondary winding structures 21. The second protrusion part 2026 is protruded from a second outer surface 2027, which is opposed to the second inner surface 2023. Moreover, the second protrusion part 2026 is located near the third opening 2020. The second protrusion part 2026 is inserted into the fourth opening 210 of the secondary winding structure 21 in order to facilitate assemblage of the transformer 2. In some embodiments, the second covering structure 202 further comprises a second salient 2028 corresponding to the notch 212 of the secondary winding structure 21. The second salient 2028 is inserted into the notch 212 of the secondary winding structure 21.

Please refer to FIGS. 5 and 6 again. In some embodiments, the first covering structure 201 further comprises a sustaining part 2019. The sustaining part 2019 is extended from an edge of the first covering structure 201. When the middle post 220*a* of the first magnetic core 220 or the middle post 221*a* of the second magnetic core 221 are partially embedded within the channel 203 of the primary side module 20, the sustaining part 2019 is contacted with the first magnetic core 220 or the second magnetic core 221 of the magnetic core assembly 22, so as to limit the position of the primary side module 20 (please refer to FIG. 3).

Moreover, the first covering structure 201 further comprises at least one first engaging structure 2019*a* and at least one second engaging structure 2019*b*. The first engaging structure 2019*a* and the second engaging structure 2019*b* are located at two opposite sides of the sustaining part 2019. An example of the first engaging structure 2019*a* includes but is not limited to a convex structure, and an example of the second engaging structure 2019*b* includes but is not limited to a concave structure. The first engaging structure 2019*a* of the first covering structure 201 of a specified primary side module 20 may be engaged with the second engaging structure 2019*b* of the first covering structure 201 of an adjacent primary side module 20. In other words, plural primary side modules 20 may be combined with each other through the engagement between the first engaging structures 2019*a* and second engaging structures 2019*b*.

Figure 7:
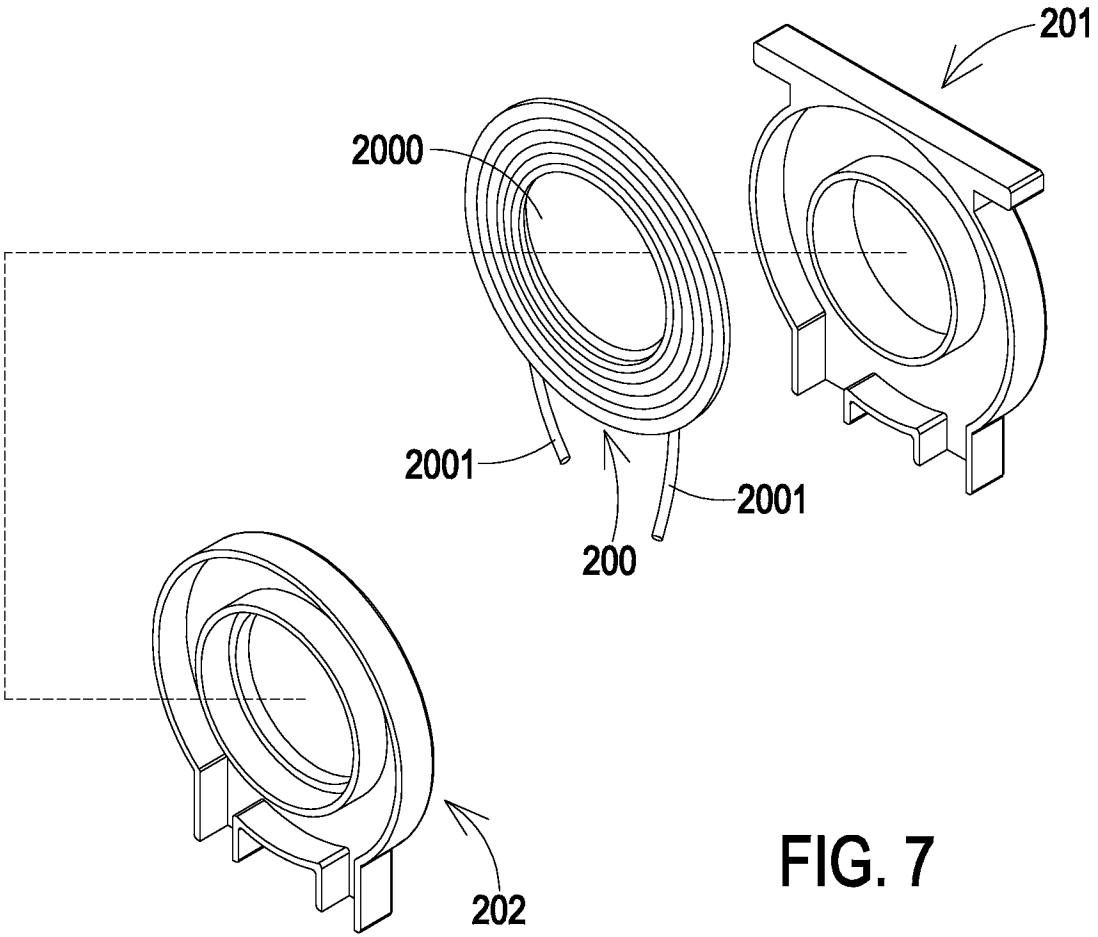
FIG. 7 is a schematic enlarged view illustrating a primary side module according to another embodiment of the present disclosure.

FIG. 7 is a schematic enlarged view illustrating a primary side module according to another embodiment of the present disclosure. In comparison with the ring-shaped conductive structure of the primary winding structure 200 of FIG. 4, the primary winding structure 200 of this embodiment is a pancake coil with a hollow portion 2000 (i.e. the first opening). Moreover, both terminals of the primary winding structure 200 are formed as two first pins 2001. Alternatively, in some other embodiments, the secondary winding structure 21 may be also a pancake coil (not shown). Alternatively, in some other embodiments, the primary winding structure or the secondary winding structure may be a winding coil (not shown).

From the above descriptions, the present disclosure provides the primary side module and the transformer with the primary side module. The transformer is fabricated by simply combining the primary winding structure, the first covering structure and the second covering structure together. By means of the first covering structure and the second covering structure, the primary winding structure can be isolated to comply with the safety regulations. Since it is not necessary to attach the insulating tape on the flat copper foil sheet of the primary winding structure, the fabricating process of the transformer of the present disclosure is time-saving and labor-saving. Moreover, the transformer of the present disclosure can comply with the safety regulations. Since the primary winding structure and the secondary winding structure are ring-shaped conductive structures, the first pins and the second pins can be directly formed on the primary winding structure and the secondary winding structure, respectively. Since it is not necessary to weld the pins on the primary winding and the second winding like the prior art, the time cost and the labor cost of the fabricating process of the transformer are further reduced. Moreover, the numbers of the primary side modules and the secondary winding structures may be expanded according to the practical requirement. Consequently, even if the power requirement is increased, it is not necessary to design and produce new molds. Under this circumstance, the universal usability of the primary side modules and the secondary winding structures will be enhanced, and the fabricating cost will be reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer, comprising:

at least one primary side module comprising:

a primary winding structure having a first opening;

a first covering structure comprising a second opening corresponding to said first opening and a first receiving recess for accommodating said primary winding structure; and a second covering structure comprising a third opening corresponding to said first opening, wherein said first receiving recess is covered and sealed by said second covering structure, and said first opening, said second opening and said third opening are in communication with each other to be defined as a channel;

at least one secondary winding structure comprising a fourth opening, which is in communication with said channel; and a magnetic core assembly partially embedded within said channel and said fourth opening;

wherein said first covering structure comprises a first main body, a first outer wall and a first inner wall, wherein said first outer wall is vertically protruded from an outer periphery of a first inner surface of said first main body, and said first inner wall is vertically protruded from an inner periphery of said first inner surface of said first main body and located beside said second opening, wherein said first receiving recess is defined by said first outer wall, said first inner wall and said first inner surface;

wherein said first inner wall is integrally formed with the first covering structure;

wherein said first covering structure further comprises a first protrusion part, and said first main body of said first covering structure further comprises a first outer surface, which is opposed to said first inner surface, wherein said first protrusion part is protruded from said first outer surface and inserted into said fourth opening of said secondary winding structure;

wherein said second covering structure comprises a second receiving recess, and said second receiving recess is accommodated within said first receiving recess.

2. The transformer according to claim 1, wherein said first covering structure further comprises a first salient, and said secondary winding structure further comprises a notch corresponding to said first salient, wherein said first salient is extended from said first protrusion part, and said first salient is inserted into said notch.

3. The transformer according to claim 1, wherein said primary winding structure comprises a plurality of first pins, and said first receiving recess comprises a plurality of first grooves corresponding to said first pins, wherein said first pins are accommodated within respective said first grooves and partially protruded out of said first grooves.

4. The transformer according to claim 1, wherein said second covering structure comprises a second main body, a second outer wall and a second inner wall, wherein said second outer wall is vertically protruded from an outer periphery of a second inner surface of said second main body, and said second inner wall is vertically protruded from an inner periphery of said second inner surface of said second main body and located beside said third opening, wherein said second receiving recess is defined by said second outer wall, said second inner wall and said second inner surface, wherein said primary winding structure is accommodated within said first receiving recess and said second receiving recess.

5. The transformer according to claim 4, wherein said primary winding structure comprises a plurality of first pins, and said second receiving recess comprises a plurality of second grooves corresponding to said first pins, wherein said first pins are accommodated within respective said second grooves and partially protruded out of said second grooves.

6. The transformer according to claim 4, wherein said second covering structure further comprises a second protrusion part, and said second main body of said second covering structure further comprises a second outer surface, which is opposed to said second inner surface, wherein said second protrusion part is protruded from said second outer surface and inserted into said fourth opening of said secondary winding structure.

7. The transformer according to claim 1, wherein a thickness of said primary winding structure is substantially equal to a depth of said first receiving recess.

8. The transformer according to claim 1, wherein said first covering structure further comprises a sustaining part, said sustaining part is extended from an edge of said first covering structure, and said sustaining part is contacted with said magnetic core assembly, so that the position of the primary side module is limited.

9. The transformer according to claim 8, wherein said first covering structure further comprises at least one first engaging structure and at least one second engaging structure, wherein said first engaging structure and said second engaging structure are located at two opposite sides of said sustaining part, wherein said first engaging structure is engaged with said second engaging structure of said first covering structure of an adjacent primary side module, so that said primary side module and said adjacent primary side module are combined with each other.

10. The transformer according to claim 9, wherein said first engaging structure is a convex structure, and said second engaging structure is a concave structure.

11. A primary side module of a transformer, said primary side module comprising:

a primary winding structure with a first opening;

a first covering structure comprising a second opening corresponding to said first opening and a first receiving recess for accommodating said primary winding structure; and a second covering structure for covering and sealing said first receiving recess, wherein said second covering structure comprises a third opening corresponding to said first opening, wherein said first opening, said second opening and said third opening are in communication with each other to be defined as a channel;

wherein said first covering structure comprises a first main body, a first outer wall and a first inner wall, wherein said first outer wall is vertically protruded from an outer periphery of a first inner surface of said first main body, and said first inner wall is vertically protruded from an inner periphery of said first inner surface of said first main body and located beside said second opening, wherein said first receiving recess is defined by said first outer wall, said first inner wall and said first inner surface;

wherein said first inner wall is integrally formed with the first covering structure;

wherein said first covering structure further comprises a first protrusion part, and said first main body of said first covering structure further comprises a first outer surface, which is opposed to said first inner surface, wherein said first protrusion part is protruded from said first outer surface and inserted into said fourth opening of said secondary winding structure;

wherein said second covering structure comprises a second receiving recess, and said second receiving recess is accommodated within said first receiving recess.

* * * * *